United States Patent [19]

Bergman

[11] Patent Number: 5,020,473

[45] Date of Patent: Jun. 4, 1991

[54] CONTROL SYSTEM FOR NOZZLE POSITIONING MOTOR

[75] Inventor: Norman J. Bergman, Danbury, Conn.

[73] Assignee: Pitney Bowes Inc., Stamford, Conn.

[21] Appl. No.: 291,461

[22] Filed: Dec. 28, 1988

[51] Int. Cl.[5] ..... B05B 13/04

[52] U.S. Cl. ..... 118/669; 118/680; 118/323; 118/324; 156/442.2

[58] Field of Search ..... 118/669, 679, 680, 323, 118/324; 156/441.5, 442.1, 442.2, 442.4

[56] References Cited

U.S. PATENT DOCUMENTS

| | | | |
|---|---|---|---|
| 2,944,511 | 7/1960 | Bach et al. | 118/243 |
| 3,911,862 | 10/1975 | Lupkas | 118/680 |
| 4,333,016 | 6/1982 | Bilstad et al. | 250/577 |
| 4,389,971 | 6/1983 | Schmidt | 118/669 |
| 4,419,384 | 12/1983 | Kane et al. | 427/57 |
| 4,428,794 | 1/1984 | Hayskar et al. | 156/442.1 |
| 4,431,690 | 2/1984 | Matt et al. | 427/424 |
| 4,491,490 | 1/1985 | Ehret et al. | 156/64 |
| 4,527,510 | 7/1985 | Arndt | 118/669 |
| 4,550,322 | 10/1985 | Tamai | 346/75 |
| 4,609,421 | 9/1986 | Yui | 156/442.1 |
| 4,634,856 | 1/1987 | Kirkham | 250/227.25 |
| 4,652,745 | 3/1987 | Zanardelli | 250/227.25 |
| 4,701,613 | 10/1987 | Watanabe et al. | 340/602 |

*Primary Examiner*—Michael Wityshyn

*Attorney, Agent, or Firm*—Charles G. Parks, Jr.; David E. Pitchenik; Melvin J. Scolnick

[57] ABSTRACT

A moistening arrangement for moistening the flap of an envelope includes a moistening device for moistening the flap of the envelope, a source of first signals that are a function of the width of the flap, a motor coupled to provide relative movement between the nozzle and the flap, and a control arrangement responsive to the first signals for controlling the motor to vary the relative positions of the flap and nozzle in a direction for moistening the flap at determined positions thereof. The control arrangement comprises an arrangement responsive to the signals for determining the rate of change of the first signals, an arrangement responsive to the rate of change below a determined rate of change for controlling the motor to move in a servo mode, and an arrangement responsive to the rate of change above the determined rate of change for controlling the motor to move in a torque mode.

3 Claims, 10 Drawing Sheets

Pump
Liquid Supply
Microcomputer
280
250
260
261
261
402
417
416
410
400
403
404
401
Id
495
103
453
451
450
205

630
631
604
608
606
603
607
609

LIQUID SUPPLY
261
250
267
620
260
610
600
601
611
605
604
603
602
621
622
623
624

CONTROL SYSTEM FOR NOZZLE POSITIONING MOTOR

BACKGROUND OF THE INVENTION

This invention relates to a method and apparatus for the application of moisture to the gummed flaps of envelopes or the like, and is more in particular directed to the rapid moistening of gummed flaps in a high speed mailing machine.

U.S. Pat. No. 3,911,862 discloses a moistening system for envelope flaps wherein a pair of fixed nozzles are aligned to selectively spray water against an envelope flap, in dependence upon the output of a sensor arranged to detect the location of the edge of the flap in the plane perpendicular to the direction of motion of the envelope that passes through the nozzles. Thus, a first of the nozzles is controlled to spray water at the flap if the sensor does not detect the envelope flap, and the other of the nozzles sprays water if the sensor does detect the envelope. In this arrangement, another sensor is arranged to control the supply of water to the nozzles when the leading edge of the envelope passes a determined position, and to inhibit the supply of water to the nozzles when the trailing edge of the envelope has passed that position. In an alternative arrangement, instead of employing two (or more) nozzles, the reference discloses the movement of a single nozzle between two end positions by means of a solenoid, under the control of the output of the flap edge position sensor, or under the control of feedback from a contoured template.

The system disclosed in the above reference, however, is not adapted to the high speed moistening of envelopes, especially since consideration is not given to the rapid change of the position of the moistener nozzle required for high speed movement of the envelopes. In addition, the above system turns the spray from the nozzle on and off solely in response to the sensing of the leading and trailing edges of the envelope, independently of the configuration of the flap, and is not adapted to compensation for response times of various movable elements of the system or control of the moisture necessary for properly moistening the envelope flaps.

SUMMARY OF THE INVENTION

Briefly stated, the invention provides a moistening arrangement for moistening the flap of an envelope, comprising a moistening device for moistening the flap of the envelope, a source of first signals that are a function of the width of the flap, a motor coupled to provide relative movement between the nozzle and the flap, and control means responsive to the first signals for controlling the motor to vary the relative positions of the flap and nozzle in a direction for moistening the flap at determined positions thereof. The control means comprises means responsive to the signals for determining the rate of change of the first signals, means responsive to the rate of change below a determined rate of change for controlling the motor to move in a servo mode, and means responsive to the rate of change above the determined rate of change for controlling the motor to move in a torque mode.

In accordance with a further feature of the invention a method is provided for moistening the flap of an envelope with an arrangement including a moistening device for moistening the flap of the envelope, a source of first signals that are a function of the width of the flap, a motor coupled to provide relative movement between the nozzle and the flap, and control means responsive to the first signals for controlling the motor to vary the relative positions of the flap and nozzle in a direction for moistening the flap at determined positions thereof, wherein the control means comprises means responsive to the signals for determining the rate of change of the first signals. The method of the invention comprises controlling the motor to move in a servo mode in response to the rate of change being below a determined rate of change for, and controlling the motor to move in a torque mode in response to the rate of change being above the determined rate of change.

BRIEF FIGURE DESCRIPTION

In order that the invention may be more clearly understood, it will now be disclosed in greater detail with reference to the accompanying drawings, wherein.

DETAILED DISCLOSURE OF THE INVENTION

Figure 2:
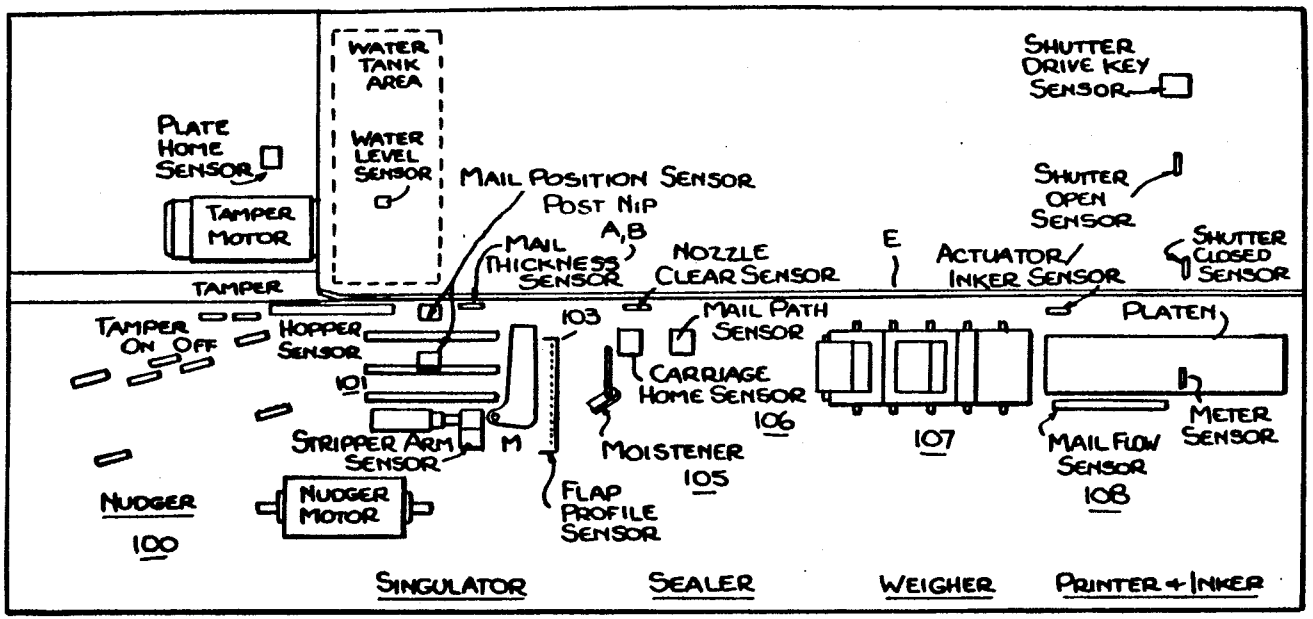
FIG. 2 is a top view of the mailing machine of FIG. 1.
Figure 1:
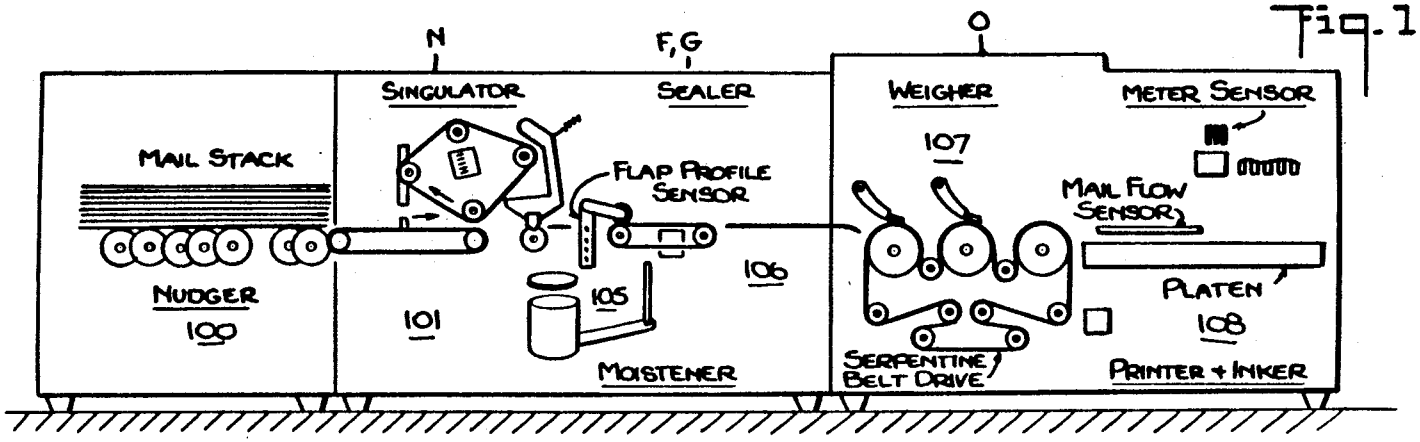
FIG. 1 is a simplified side view of a mailing machine which may encorporate the moistener of the invention.

A mailing machine of the type with which the present invention may be employed is illustrated generally in FIGS. 1 and 2. As illustrated, mail may be stacked on a mailing machine in the region 100 disclosed, for example, in copending application Ser. No. 291,467, now U.S. Pat. No. 4,973,037. The mail is fed from the stacking region 100 to a singulator 101 for separation of individual pieces of mail The singulator may be of the type disclosed, for example, in copending application Ser. No. 291,098, now U.S. Pat. No. 4,909,499. Following the separation of individual envelopes, the envelopes pass a flap profile sensor 103, as disclosed for example in co-pending application Ser. No. 291,092, now U.S. Pat. No. 4,924,106, to provide electrical signals for storage in a memory 222 corresponding to the profile of the envelope flap. Data stored in the memory 222 is employed to control the movement of a moistener 105, to which the present invention is directed. The moistener is moved to spray water on the adhesive region of the envelope flap, as will be discussed Following moistening, the envelope flaps are sealed in a sealing region 106, and directed to a weigher 107. The weigher may be of the type, for example, disclosed in co-pending application Ser. No. 134,625, now abandoned. Following weighing, indicia may be printed on the envelopes by a printer and inker assembly 108 as disclosed, for example, in co-pending U.S. patent application Ser. No. 526,954.

It is of course apparent that the moistening arrangement of the present invention may alternatively be employed in other mailing systems.

Figure 3:
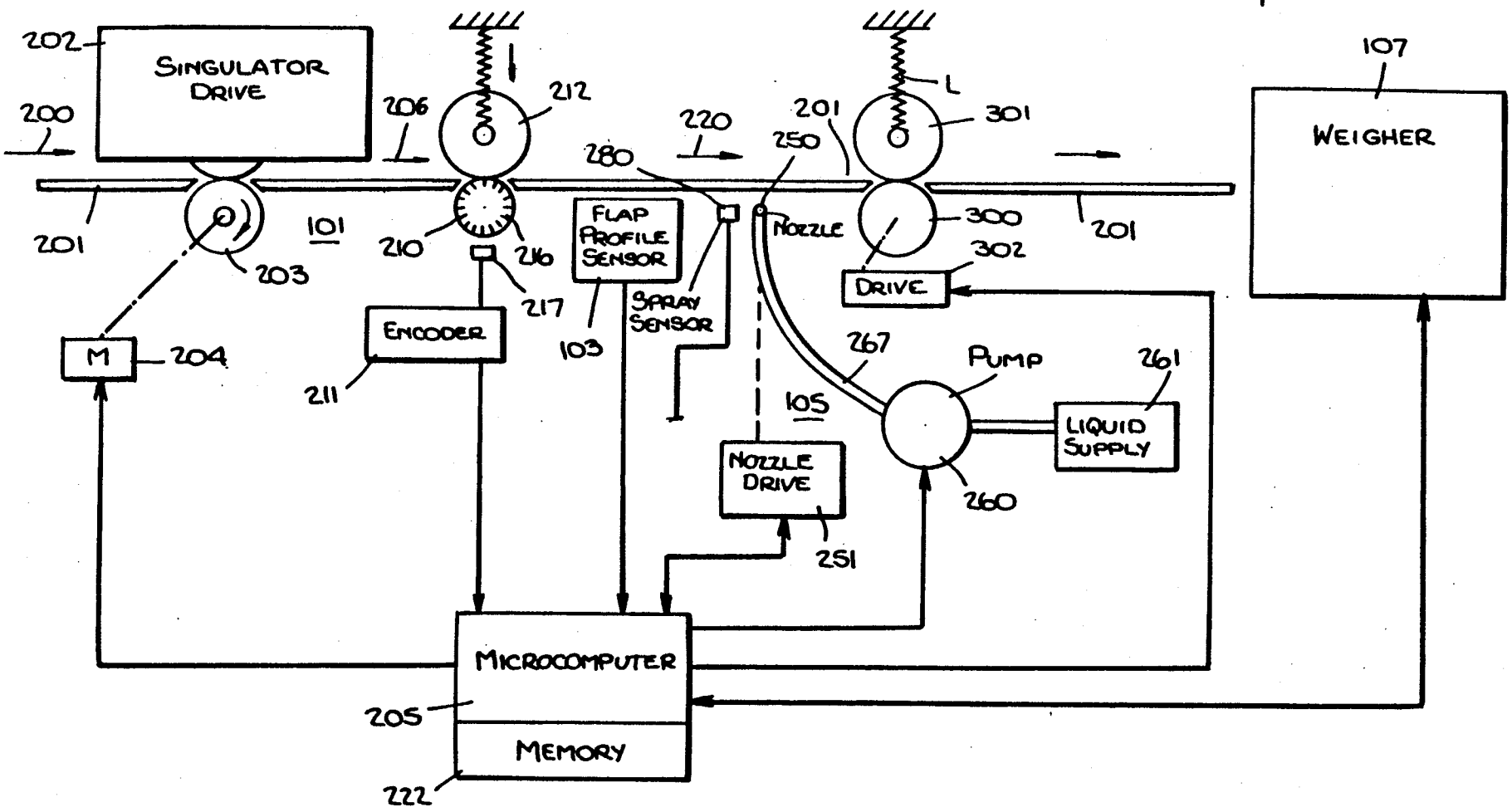
FIG. 3 is a simplified diagram of a moistening system in accordance with the invention.

A preferred embodiment of a moistening system in accordance with the invention is illustrated in further detail, along with the adjacent elements of a mailing machine, in FIG. 3. As illustrated in FIG. 3, mail is directed in the direction of arrow 200 onto a drive deck 201, which may be horizontal or slightly inclined as discussed, for example, in co-pending U.S. application Ser. No. 291,467. The mail is separated into individual pieces at singulator drive 202, the drive being depicted by drive roll 203 driven by a motor 204. The motor is controlled by a microcomputer 205. While reference is made in this application to drive rollers, it is apparent that drive belts may also be employed for the function of transporting the mail along the deck 201. Prior to being directed to the singulator, the flaps of the mail had been opened by conventional technique, to extend downwardly through a slot of the deck 201. A rear guide wall (not shown) may be provided for laterally guiding the mail, for example as illustrated in co-pending application Ser. No. 291,024, now U.S. Pat. No. 4,930,764. It is thus apparent that individual envelopes are driven by singulator drive 202, in the direction of arrow 206.

In accordance with one feature of the invention, it is necessary to provide a signal corresponding to the speed of envelopes having flaps to be moistened by the moistener 105. It has been found that the rotational or other movements in the singulator drive are not sufficiently accurate for the purpose of controlling the position of a moistener, in view of the slip which normally occurs in the singulator. Accordingly, an encoding roll 210 is provided down stream of the singulator, the rotation of the roll 210 being encoded by an encoder 211, to provide a pulse train of pulses to the microcomputer 205 corresponding to the instantaneous rate of rotation of the roll 210. Envelopes (not shown in FIG. 3) are directed to press against the roll 210 by a bias roller 212. The roll 210 may be provided with suitable conventional markings 216 about its periphery adapted to be sensed by photo sensor 217, for applying speed related impulses to the encoder 211. It is of course apparent that other techniques may be employed for applying signals corresponding to the speed of rotation of the encoder roll 210 to the microcomputer 205.

The envelopes merging from the nip of the encoder roll 210 and bias roll 212 are directed, as indicated by the arrow 220, to the flap profile sensor 103. As discussed above, a preferred embodiment of the sensor 103 is disclosed in copending application Ser. No. 291,092, now U.S. Pat. No. 4,924,106. This sensor directs signals corresponding to the instantaneously sensed width of an envelope flap passing thereby, to the microcomputer 205, for storage in a memory 222. The sensor 103 is preferably adapted to sense the flap width at predetermined longitudinally spaced apart intervals, for example, at times corresponding to predetermined numbers of pulses output from the encoder 211.

Downstream from the flap profile sensor, the nozzle 250 of the moistening system 105 is moved by the nozzle drive 251 under the control of the microcomputer 205, to position the nozzle at a location corresponding to the width of the flap of the envelope then positioned at the moistening station. The intended position of the nozzle is hence controlled as a function of the data stored in the memory 222 in response to the output of the flap profile sensor, the velocity stored in the memory 222 in response to the output of the encoder 211, and the known distance between the flap profile sensor and the moistening station.

The microcomputer 205 also controls a pump 260 for directing a determined quantity of liquid from the liquid supply 261 to the nozzle 250 by way of tube 267. Thus, the microcomputer receives data corresponding to the length of the area to be moistened on an envelope, from the flap sensor. Further data may be stored in memory corresponding to standard envelope flaps, so that the microcomputer can determine the shape of the flap to be moistened on the basis of a minimum number of initial sensings of flap width. This information may be employed by the microcomputer to control the quantity of liquid to be pumped by the pump 260.

Figure 5:
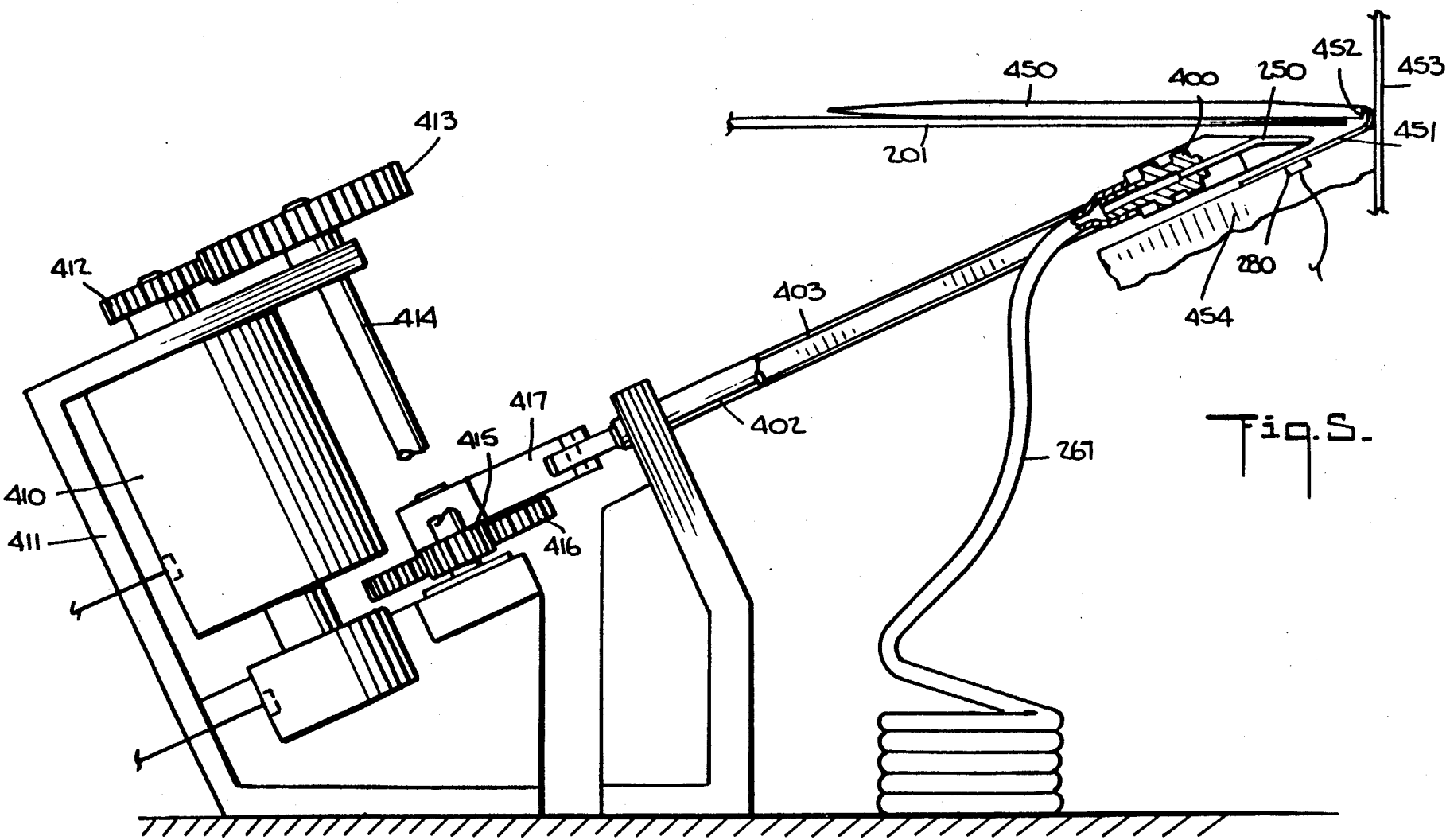
FIG. 5 is a partial end view of the moistener with the nozzle in its most forward position.

In accordance with the invention, a sensor 280 FIG. 5 may be provided at a determined position of the nozzle, for example at an initial position of the nozzle out of alignment with the flap to be moistened. Prior to controlling the nozzle drive in preparation to moistening the flap of an envelope, the microcomputer controls the pump 260 to emit a jet of liquid from the nozzle for a predetermined time. The sensor 280 is positioned to intercept this jet, either by transmission or reflection, to provide a signal to the microcomputer that the jet nozzle is functioning properly, and that the liquid supply 261 is adequately filled to moisten the flap of the envelope currently being directed to the moistener. Downstream of the moistener, the envelope is directed to the nip between a drive roller 300 and its respective back up roller 301. The drive roller 300 is controlled by motor drive 302 under the control of the microprocessor 205. The drive roller 300 is spaced from the drive roller 203 a distance such that the envelope is continually positively driven. It will be observed, however, that due to the spacing between the encoder roller 210 and the drive wheel 300, the encoder 211 will not provide timing pulses corresponding to the speed of movement of the envelope as the trailing edge of the flap passes the nozzle 250. At this time, the speed of the envelope, for the purposes of positioning the nozzle 250, is determined by the microcomputer, and corresponds to the speed of which the microcomputer controls the roller 300. Since the roller 300 does not form part of a singulator, it is not necessary to consider slipage between the speed of the envelope and the rotational speed of the roller, and hence it is not necessary to provide an additional encoder wheel downstream of the moistener.

Following the drive roller 300, the envelope may be directed to a weigher 107 for further processing. Prior to passing to the weigher, the flap may be folded by conventional means to contact the remainder of the envelope, for sealing.

Figure 4:
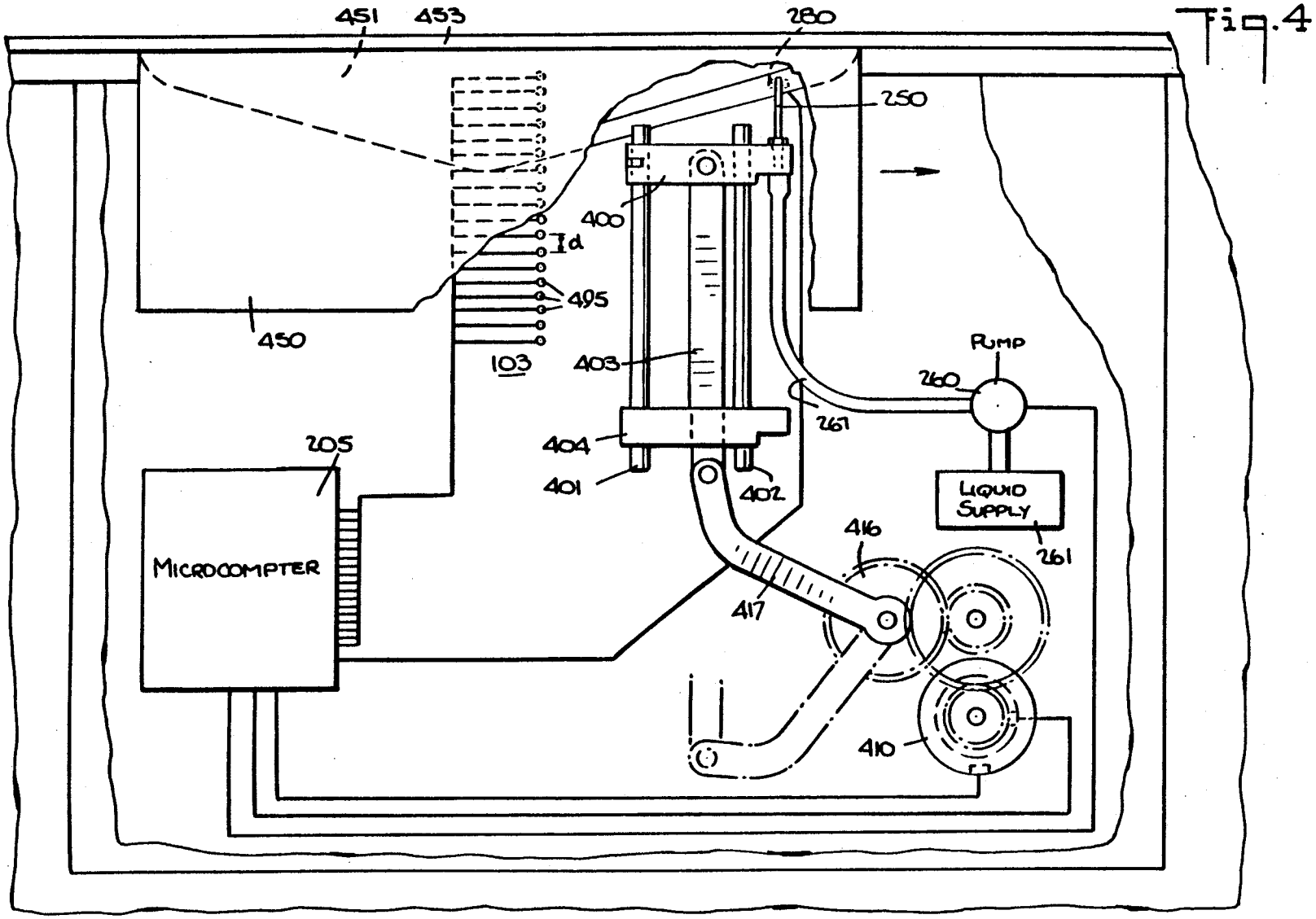
FIG. 4 is a simplified diagram illustrating the nozzle control arrangement of the invention.
Figure 6:
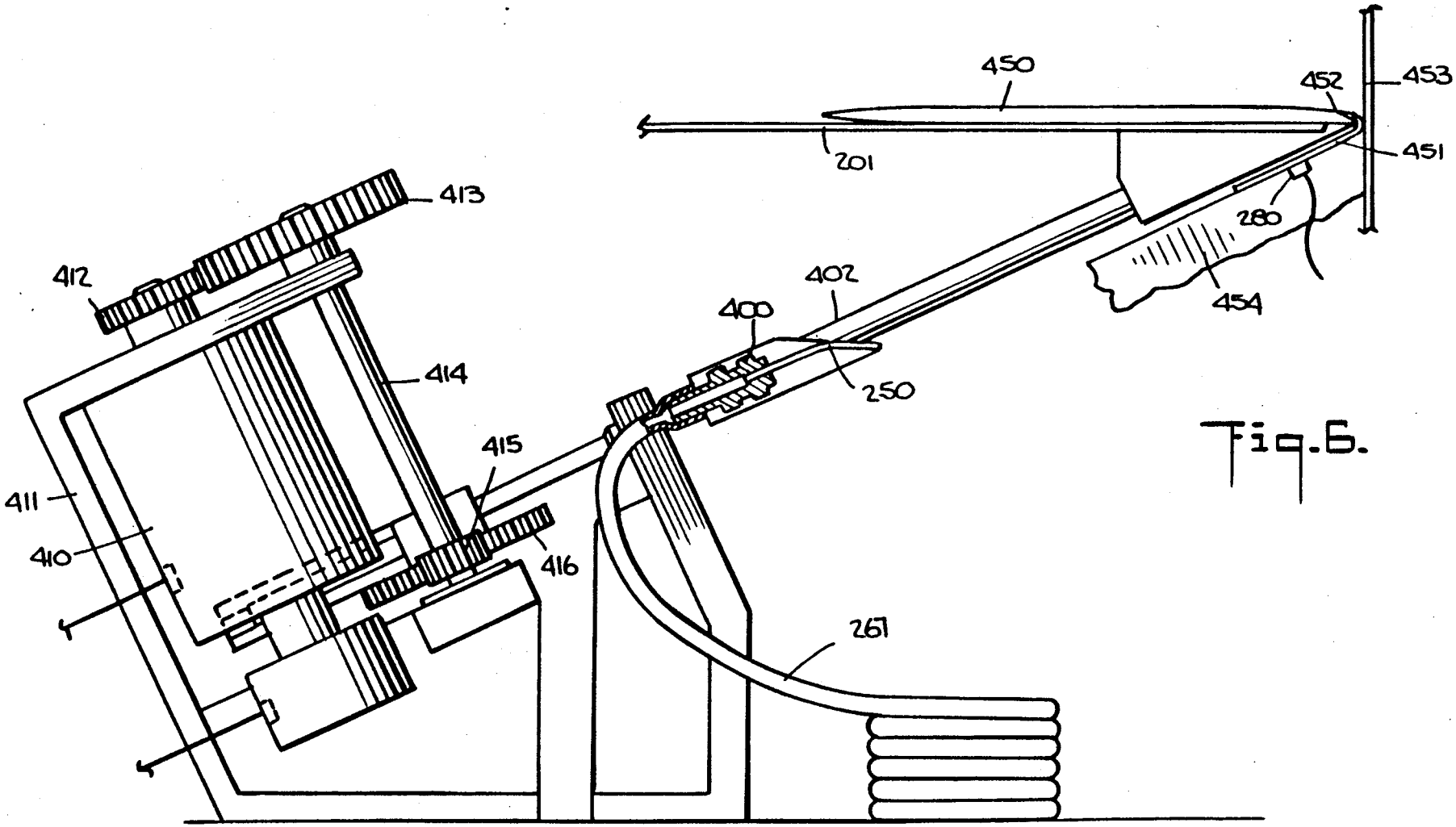
FIG. 6 is a partial end view of the moistener with the nozzle in its most rearward position.

A preferred mechanism for controlling the nozzle is illustrated in FIGS. 4, 5 and 6. As illustrated in these figures, the nozzle 250 is connected by way of the flexible tube 267 to the pump 260. The nozzle is held on a slide 400 slidably mounted on a pair of fixed guide rods 401, 402. As illustrated in FIGS. 5 and 6, the guide rods extend below the deck 201 at angle, for example, 25° to the horizontal. An operating link 403 is pivoted to the slide 400, and guided in a guide block 404 affixed to the guide rods for movement parallel to the guide rods.

A servo motor 410, mounted on a fixed frame 411, as illustrated in FIGS. 5 and 6, is connected to the microcomputer 205 for controlling the position of the nozzle. The motor 410 has a pinion 412 on its shaft, coupled to a gear 413 on shaft 414 mounted for rotation in the frame 411. Gear 415 on the shaft 414 drives a gear 416 also mounted in the frame 411. A link 417 affixed for rotation with the gear 416, is pivoted to the lower end of the link 403. As a consequence, the rotational displacement of the shaft of the servo motor 410 is coupled to move the slide 400 along the guide rods 401, 402, between a uppermost position illustrated in FIGS. 4 and 5, and a lower position as illustrated in FIG. 6. The lowermost position is also illustrated in FIG. 4.

Figure 7:
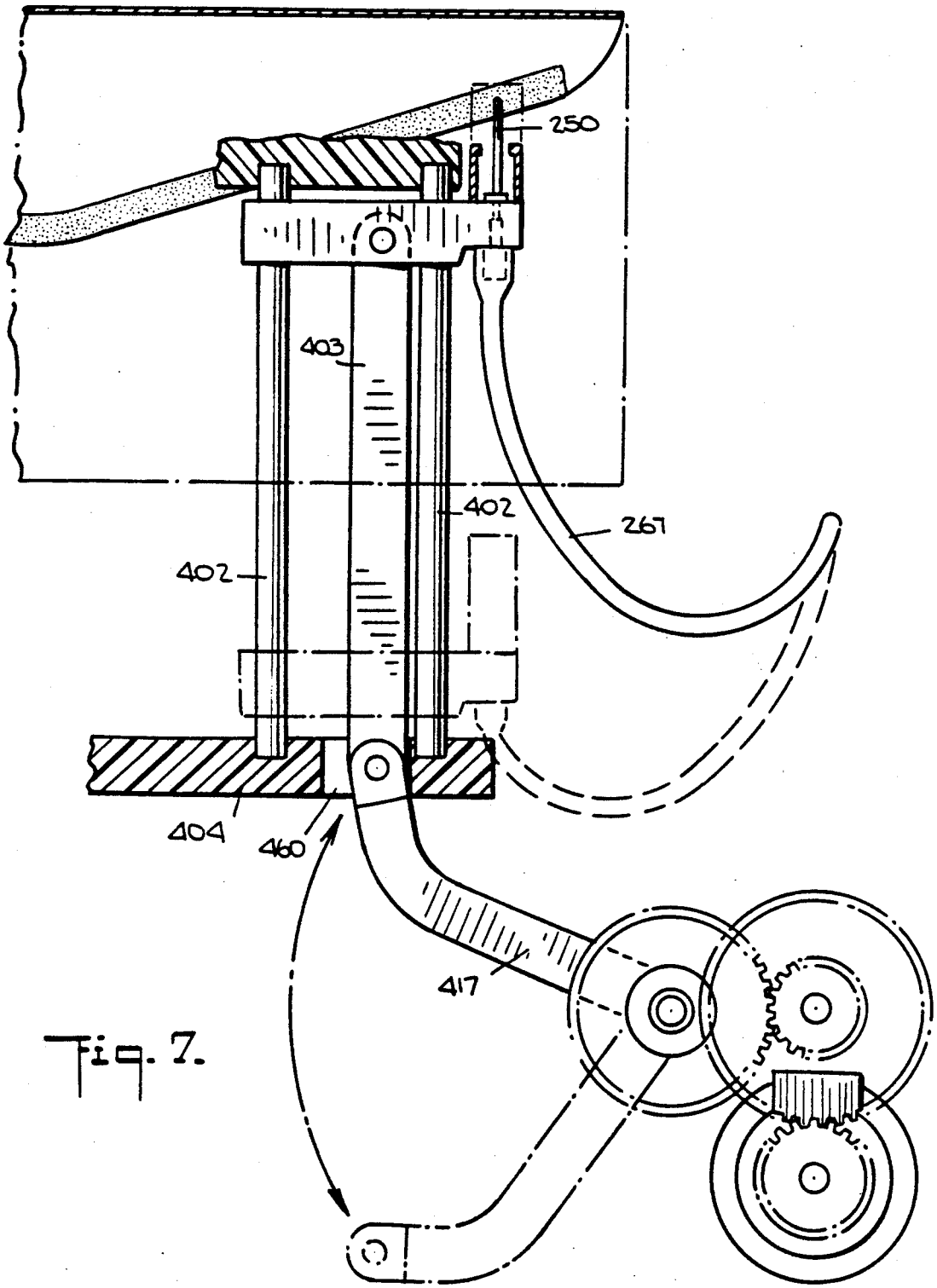
FIG. 7 is an enlarged view of the nozzle control arrangement.

As illustrated in FIG. 5, an envelope 450 positioned for movement along the deck 201 has a flap 451 extending through the gap between an edge 452 of the deck and the lateral guide wall 453. The flap is guided to extend in a plane parallel to the plane of guide rods 401, 402 by an inclined guide wall 454. The nozzle 250 is directed to spray water downward against the gummed side of the flap, as illustrated in FIG. 5. As more clearly illustrated in FIG. 7, the guide block 404 has a slot 460 for receiving the link 403, in order to permit the necessary lateral movement of the lower end of the link 403 upon rotation of the link 417.

Figure 8:
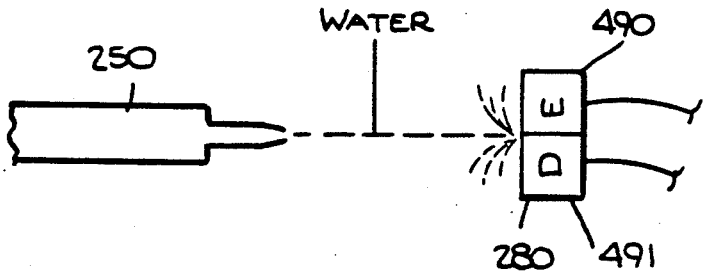
FIG. 8 is an illustration of the sensing arrangement for determining the operating condition of the moistener.
Figure 9:
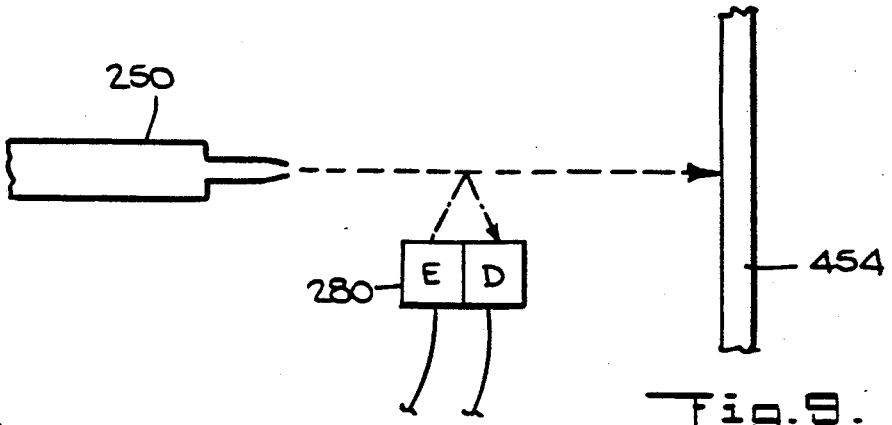
FIG. 9 is an illustration of a modification of the sensing arrangement.

The sensor 280 for sensing the spray of water from the nozzle may be mounted in the guidewall 454, as illustrated in FIGS. 4 and 5. The sensor may be positioned to directly receive the spray from the nozzle, as illustrated in FIG. 8, wherein the sensor 280 includes a radiation emitter 490 and a radiation detector 491. Water directed to the sensor alters the radiation path between the emitter and the detector, to provide an output responsive to the spraying of water towards the sensor. Alternatively, as illustrated in FIG. 9, the sensor 280 is positioned laterally of the path of the spray, so that, in the presence of the spray, radiation from the emitter is reflected back to the detector, to indicate the presence of a correct spray.

Figure 10:
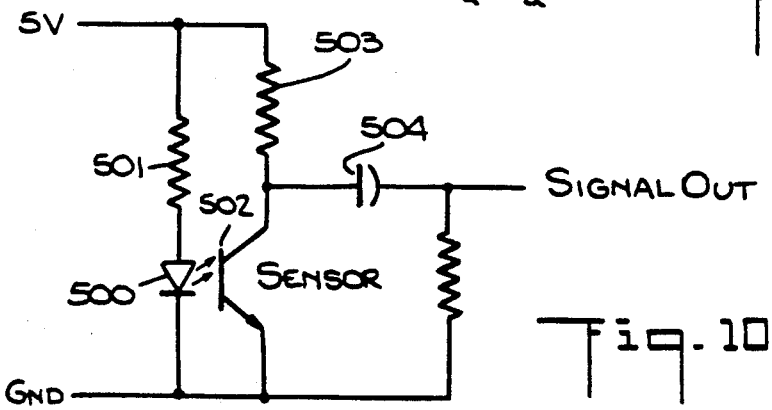
FIG. 10 is a schematic diagram of a circuit that may be employed for the sensor.

A preferred circuit for coupling the sensor 280 to the microcomputer is illustrated in FIG. 10, wherein a light emitting diode 500 is continually connected to the operating voltage source by way of a resistor 501, and the current path of phototransistor 502 is also continually connected to the operating source by way of a resistor 503. The collector of the phototransistor is coupled to the microcomputer by way of a capacitor 504. It is thus apparent that changes in the radiation from the photodiode 500 reaching the phototransistor, such as occurs during the momentary spraying of water at the photosensor, results in a pulse coupled to the microprocessor by way of the capacitor.

Figure 11:
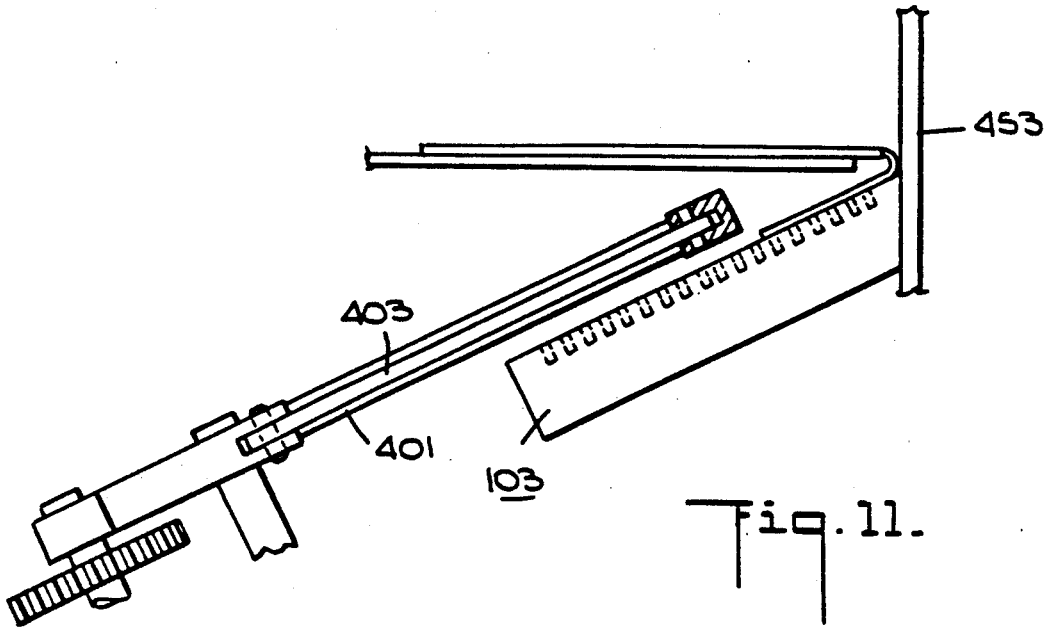
FIG. 11 is a simplified end view of the moistener illustrating the relative positions of the moistener and the flap sensor.

Referring again to FIG. 4, it is apparent that the individual sensors and emitters 495 of the profile sensor 103 extend in a row parallel to the direction of movement of the nozzle 250, and are spaced therefrom a distance d. As further illustrated in FIG. 11, the row of sensors 103 are also inclined to the horizontal at substantially the same angle as the guide rods 401, 402.

Figure 12:
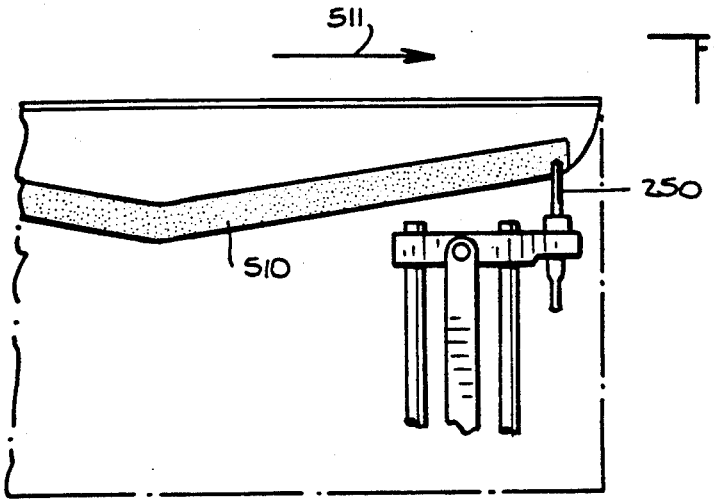
FIGS. 12–14 illustrate sequential positions of the nozzle during the moistening of a flap.
Figure 13:
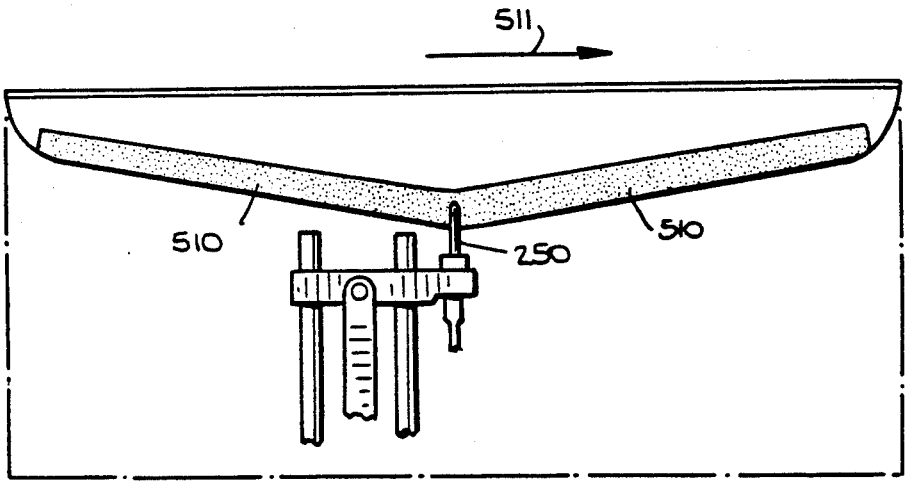
Figure 14:
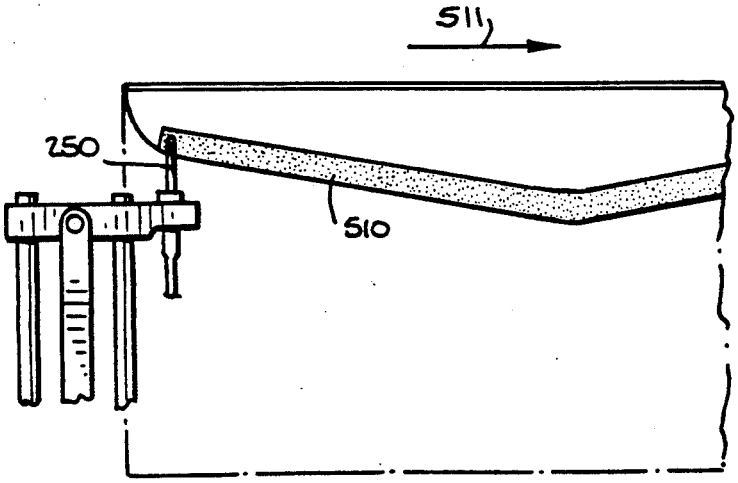

As illustrated in FIGS. 12–14, in accordance with the invention the nozzle 250 may be continually moved in alignment with the gummed region 510 of a flap, as the envelope is moved along the deck in the direction of the arrow 511.

Figures 15, 16:
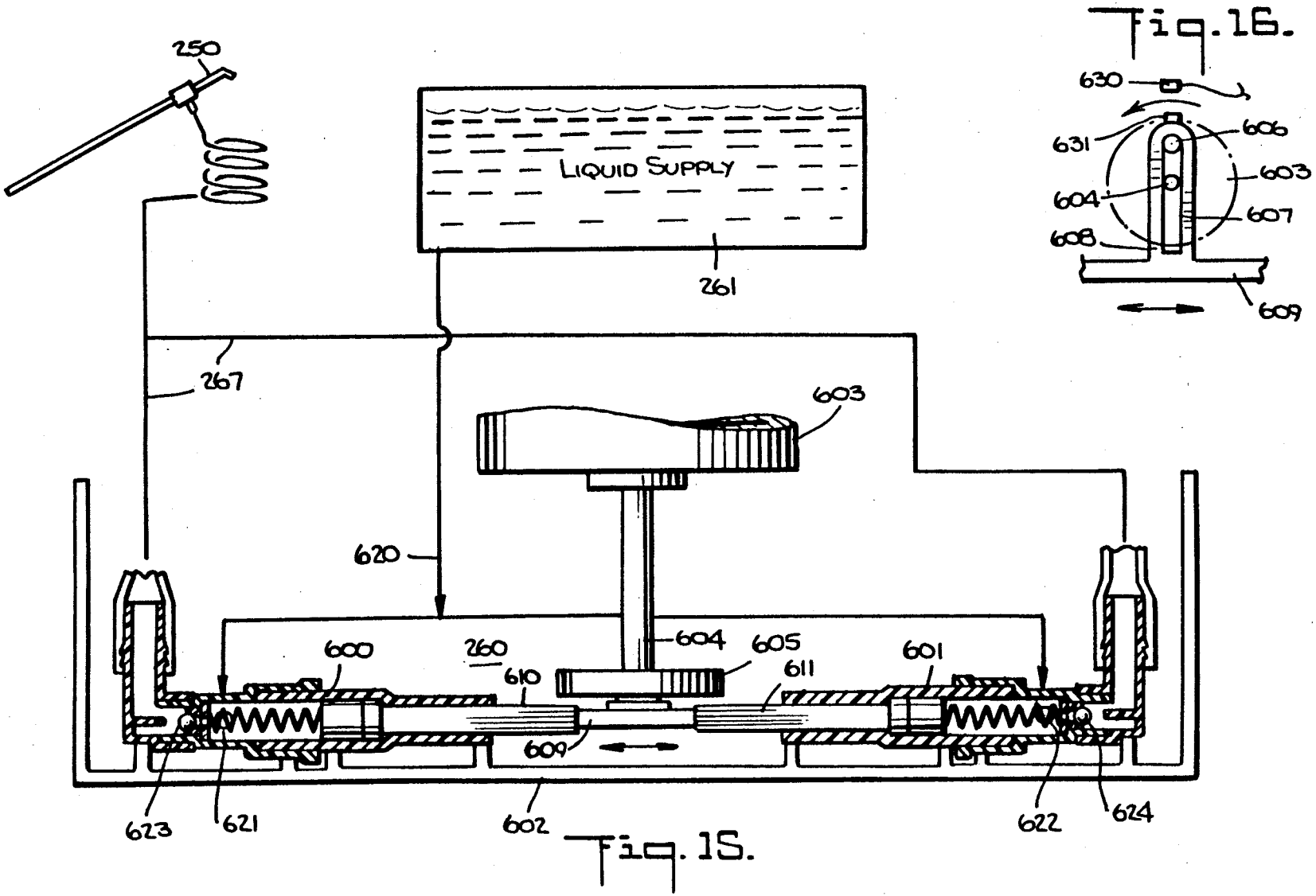
FIG. 15 is a partial cross-sectional view of a pump assembly for the liquid, in accordance with one embodiment of the invention.
FIG. 16 is a plan view of a portion of the pump assembly of FIG. 15.

A preferred embodiment of a pump 260 for pumping the liquid, for example water, to the nozzle, is illustrated in FIGS. 15 and 16. This pump is illustrated as having two cylinders 600, 601 coaxially mounted at spaced apart positions on a frame 602, i.e. the frame of the mailing machine. A servo motor 603 has a shaft 604 adapted to rotate disk 605. The disk 605 carries a projection 606 that extends into a slot 607 in an arm 608 extending perpendicularly from a piston shaft 609. The piston shaft 609 carries pistons 610, 611 on opposite ends thereof which extend into the cylinders 600, 601 respectively. The liquid supply 261 is coupled to each of the cylinders by way of tubing 620 and inlet valves 621, 622 respectively. Outlet valves 623, 624 of the cylinders are coupled to the tube 267 for supplying liquid to the nozzle 250. As illustrated in FIG. 16, a sensor 630 may be provided, cooperating with a marking 631 or the like of the disk 605, to enable signalling to the microprocessor of the center positioning of the two pistons.

It will of course be apparent that, if desired, only a single cylinder and piston arrangement may be provided.

In the illustrated pump, the motor 603, adapted to be connected to the microcomputer, is controlled by the microcomputer to rotate each shaft a determined amount, depending upon the desired amount of liquid to be supplied to the nozzle. The rotation of the shaft of the motor, and the resultant angular displacement of the pin 606, results in linear movement of the piston shaft 609, and hence of the pistons affixed thereto. The pistons force the liquid from the cylinders by way of their respective output valves 623, 624, and to the nozzle 250 by way of the tubing 267. Reverse rotation of the shaft 604 effects the drawing of liquid from the supply 261 into the respective cylinders 600, 601. The sensor 630, responsive to the position of the marking 631, enables the microcomputer to reposition the shaft 604 in a central position, so that the amount of liquid dispensed can be accurately controlled. The arrangement illustrated in FIGS. 15 and 16 thereby enables full control of the amount of liquid applied to the nozzle for the moistening of each flap. The aperture of the nozzle 250 is preferably sufficiently small that the nozzle act as a hypodermic needle, i.e. so that the amount of flow is independent of the pressure applied thereto from the pump. This results in an even distribution of liquids sprayed throughout the gummed portion of the envelope flap.

As discussed above, the flap profile sensor 103 generates a signal periodically (for example for every inch of movement of the envelope), and this information is stored in a table in the memory 222. The envelope velocity is also periodically sensed and stored in the memory 222. This data along with the response time of the moistening assembly, is needed in order to correctly position the nozzle. It is further necessary to enter the distance of travel of the envelope, from the profile sensor to the nozzle, for determining the correct position of the nozzle.

In accordance with one embodiment of the invention, the slope of the flap, i.e. the rate of change of width of the flap between successive sensing periods, is determined. This function is of course a function of the velocity of movement of the envelope. If the slope determined by the microcomputer is below a predetermined level, it is possible to control the movement of the nozzle in the servo mode, i.e. the motor is controlled directly by conventional means in response to the detected slope. If the slope is greater than a predetermined level, however, such that the motor cannot respond adequately quickly to correctly position the nozzle, then conventional circuitry is employed to operate the motor in a torque mode, i.e. by directing a current pulse of determined magnitude and duration to the motor to properly drive the nozzle.

The flap position table responsive to the output of the flap sensor is built in the microcomputer by reading the flap width for every "k" encoder counts, i.e. fixed distances. If the response time of the nozzle control motor is considered to be substantially zero, then it is merely necessary to fetch a value from the table which corresponds to the distance d (from the flap detector to the nozzle, from the currently read flap reading) In other words, in this case the microcomputer points to a position in the table that is d/k positions displaced from the currently read position, in order to determine the flap width at the position of the nozzle. Since the response time of the nozzle adjustment system is not zero, it is of course necessary to subtract this response time from the distance d.

The distance x that the envelope travels during the response time of the moving parts of the moistener may be shown to be equal to:

$$X=Tr*V+C$$

where Tr is the response time of the moistener, V is the detected velocity of the envelope, and $C=a*Tr^2/2$, and a is the calculated acceleration of the envelope. The number n of positions in the table (i.e. from the position that corresponds at that instant to the position of the nozzle), is hence:

$$n=(d-x)/k$$

Figure 17:
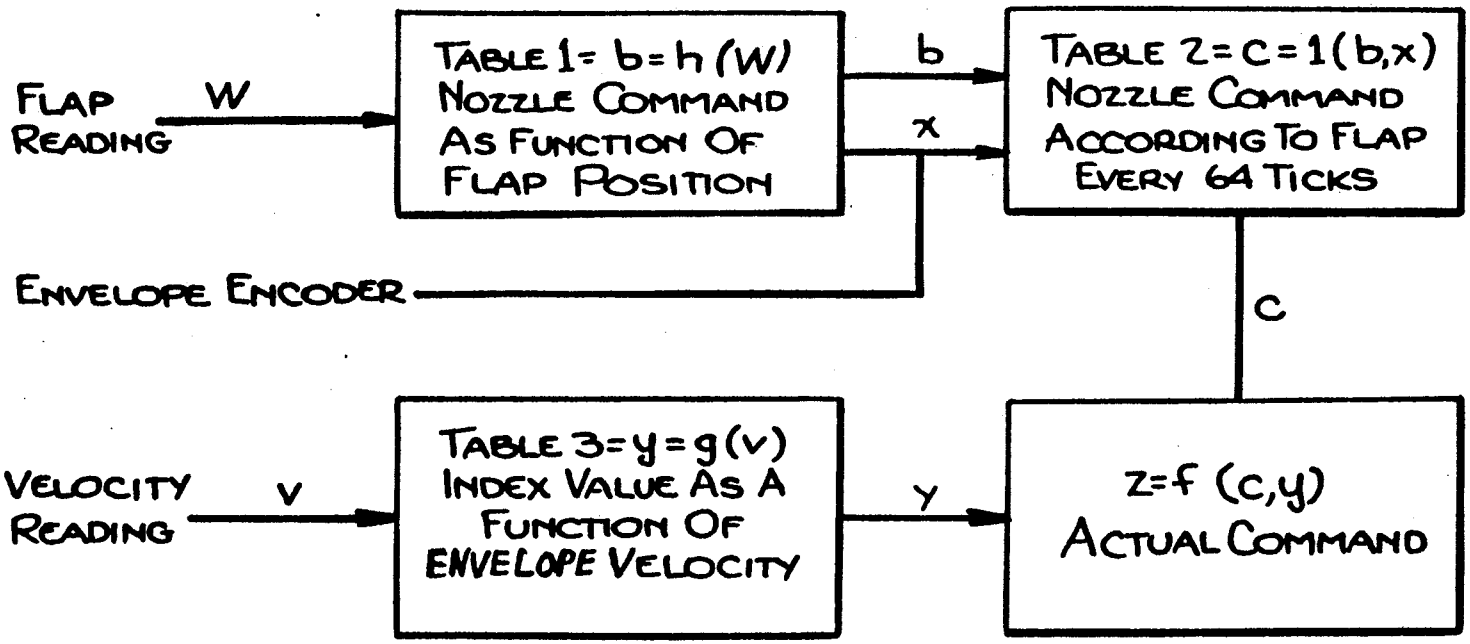
FIG. 17 illustrates three tables used to calculate a command for positioning the moistener.

In accordance with the invention, as illustrated in FIG. 17, a quantity b that is a value of a function h of the flap width w is stored in a first table in the memory. A second table is prepared, storing a quantity c that is a value of a function 1 of the quantity b obtained from the first table and the response distance, at times responsive to determined numbers of pulse outputs of the envelope velocity encoder. A third table is also prepared for storing a quantity y that is a value of a function g of the velocity v of the envelope. The actual command z to the moistener, then, is a value of a function f of the stored quantities c and y obtained from the second and third tables.

When the slope of the flap profile exceeds a certain value, the servo mode of motor control is not sufficient in tracking, and torque mode must be used.

The slope of the edge of the envelope is calculated by looking at the value of the flap position at the beginning and the end of a predefined section of the envelope. The 1st section is from the point where the flap changes from zero to a point at, for example, one inch from the zero point. If the value of the flap position at this point exceeds a certain value, then torque control of the motor should be used. The value of the torque and the duration for which it should be applied, is a function of the slope (flap position in this case). The slope of the next section will determine the type of the envelope. If the envelope is one type, the tracking will continue in servo mode until a further point. Otherwise, the process will look for the envelope tip. This is done by comparing a pair of adjacent points. When the second compared point is less than the previous point, it means that the envelope tip has been detected, where again some torque is needed to overcome the change in direction of the flap profile. This torque is also a function of the slope. At the point where the flap detector senses the flap's end, the actual position of the nozzle is fetched (the next command to be used), and if the nozzle is more than a predefined distance from home, torque mode is applied to return it home faster.

Generally it is desirable that the slope be calculated more often, so that every change will be detected and the appropriate nozzle command will be generated. There are two processes that will take place concurrently, the process of generating the nozzle command for the servo mode, and the process of generating the command for torque mode which should override the servo mode if TFF (turbo mode) is to be employed. The torque mode is time based in a sense that it is to be in effect starting t1 milliseconds from the present and then lasting for t2 ms. These quantities are calculated according to the following algorithm:

Every one inch the slope of the flap is calculated. There are 8 positive levels and 8 negative levels of slope.

The difference between the new slope and the old slope serves as a pointer to a table: the columns of this table include; Torque/Servo; Torque value., Duration. The first column signals if torque mode is to be applied; the others are the value, and the time for this interval.

If torque mode is needed, the delay time before it is applied is calculated.

The general equation for this calculation is:

$$x=v_0*t+a*t^2/2$$

where $V_0$ is the velocity at the present,
a is the slope of the velocity profile,
x is the distance,
and t is the time to reach distance 'x'.
If x=d, and solving for 't' as a function of $V_0$:

$$t*t+2V_0*t/a-2d/a=0$$

$$t=(\tfrac{1}{2})(-2V_0/a+\text{square root }(4V_0^2/a^2+8d/a)).$$

From this result, a table can be constructed, and the delay time to be fetched according to the measured velocity.

Some adjustments may be made, if desired, to reflect the flat part of the velocity profile, and the distance passed during response time.

While the invention has been disclosed with reference to a limited number of embodiments, it will be apparent that variation and modifications may be made therein, and it is therefore intended in the following claims to cover each such variation and modification as falls within the true spirit and scope of the invention.

What is claimed is:

1. A moistening arrangement for moistening a flap of an envelope said flap having a varying width, comprising a nozzle for moistening said flap of said envelope, a source of first signals that are a function of said width of said flap, a motor coupled to provide relative movement between said nozzle and said flap, and control means responsive to said first signals for controlling said motor to vary the relative positions of said flap and nozzle in a direction for moistening said flap at determined positions thereof, said control means comprising means responsive to said first signals for determining a rate of change of said width, means responsive to said rate of change being below a determined rate of change for controlling said motor to move in a servo mode, and means responsive to said rate of change being above said determined rate of change for controlling said motor to move in a torque mode.

2. A moistening arrangement for moistening a flap of an envelope moving in a first direction in a given plane, said flap having a varying width, comprising a nozzle for directing a spray of a liquid at said flap along a given locus in said plane, a source of first signals that are a function of said width of said flap in said plane and a motor coupled to drive said nozzle, and control means responsive to said first signals for controlling said motor to move said nozzle in a direction substantially parallel to said plane for moistening said flap at positions thereof, said control means comprising means responsive to said signals for determining a rate of change of said width, means responsive to said rate of change being below a determined rate of change for controlling said motor to move in a servo mode, and means responsive to said rate of change being above said determined rate of change for controlling said motor to move in a torque mode.

3. In a moistening arrangement for moistening a flap of an envelope moving in a first direction in a given plane, said flap having an edge, said arrangement having a nozzle directed to spray a liquid at an envelope flap along a given locus in said plane, a source of first signals that are a function of the position of said edge in said plane and means responsive to said first signals for moving said nozzle in a direction substantially parallel to said plane for moistening said flap at positions thereof; the improvement wherein said means for moving said nozzle comprises a motor, link means mechanically coupling said motor to move said nozzle along said locus, and control means responsive to said first signals for controlling said motor, said control means comprising means responsive to said first signals for determining a rate of change of said position of said edge, means responsive to said rate of change being below a determined rate of change for controlling said motor to move in a servo mode, and means responsive to said rate of change being above said determined rate of change for controlling said motor to move in a torque mode.

* * * * *